United States Patent [19]

MacBain

[11] Patent Number: 4,673,367

[45] Date of Patent: Jun. 16, 1987

[54] ANIMATED FIGURE TOY

[75] Inventor: Ronald H. MacBain, Los Angeles, Calif.

[73] Assignee: Mattell, Inc., Hawthorne, Calif.

[21] Appl. No.: 780,061

[22] Filed: Sep. 25, 1985

[51] Int. Cl.[4] ..... A63H 33/00; A63H 3/20; A63H 19/00

[52] U.S. Cl. ..... 446/4; 446/330; 446/365

[58] Field of Search ..... 446/4, 5, 6, 308, 309, 446/310, 311, 330, 352, 353, 359, 360, 99, 100, 365, 473; 273/380, 381, 127 A, 85 F, 390

[56] References Cited

U.S. PATENT DOCUMENTS

| | | | |
|---|---|---|---|
| 1,300,177 | 4/1919 | Kohn | 446/4 X |
| 1,550,989 | 8/1925 | Stephens | 446/97 |
| 2,269,095 | 1/1945 | Davis | 446/334 |
| 2,597,094 | 5/1952 | Gutmann | 446/6 |
| 2,996,833 | 8/1961 | Giuliano | 446/4 |
| 3,235,259 | 2/1966 | Glass et al. | 273/85 F |
| 3,346,989 | 10/1967 | Ryan et al. | 446/198 |
| 3,687,452 | 8/1972 | Thompson | 446/4 X |
| 3,734,500 | 5/1973 | Cooper | 273/380 X |
| 3,874,112 | 4/1975 | Sapkus | 446/333 |
| 4,118,888 | 10/1978 | Ogawa | 446/309 X |
| 4,125,961 | 11/1976 | Yamashina | 446/308 |
| 4,136,481 | 1/1979 | Nicholls | 446/100 X |
| 4,185,412 | 1/1980 | Rahmstorf | 446/100 X |
| 4,246,722 | 1/1981 | Sapkus et al. | 446/339 X |
| 4,319,751 | 3/1982 | Kurushima et al. | 446/4 X |
| 4,560,362 | 12/1985 | Renger | 446/340 |
| 4,565,537 | 1/1986 | Klimpert et al. | 446/6 X |
| 4,571,197 | 2/1986 | Kulesza et al. | 446/6 |
| 4,575,349 | 3/1986 | Piazza et al. | 446/330 |
| 4,623,318 | 11/1986 | Tsiknopoulos et al. | 446/330 |

FOREIGN PATENT DOCUMENTS 8133 3/1916 United Kingdom .

*Primary Examiner*—Robert A. Hafer
*Assistant Examiner*—D. Neal Muir
*Attorney, Agent, or Firm*—Ronald M. Goldman; Melvin A. Klein; Daniel F. Sullivan

[57] ABSTRACT

An animated figure toy having a lower torso with a trunnion member coupled for rotatable movement, the trunnion including hinge couplers connectable to mating hinge portions on the interior of front and rear halves of the upper torso. A spring is positioned beneath the trunnion for coaction with an actuating post slidingly captively retained within the trunnion for limited axial movement, the post having pivotably attached thereto a head supporting member with a head thereon. Engaging interlocking fingers on the interior of the front and rear halves of the torso hold the parts together, with an actuating member slidably mounted on one of the fingers engageable by a plate portion on the front torso for separation of the arms and movement of the post under force of the spring to pivot the parts outwardly.

26 Claims, 6 Drawing Figures

ANIMATED FIGURE TOY

BACKGROUND OF THE INVENTION

The background of the invention will be discussed in two parts:

1. Field of the Invention

This invention relates to animated figure toys, and more particularly to an animated figure toy with a torso constructed to appear to collapse on actuation.

2. Description of the Prior Art

Toy figures having posable or movable articulated limbs are very popular with children, with some such figures being referred to as action figures. Action figures usually have some distinguishing features or characteristics, such as being configured as the super hero type of figure, and usually such figures are provided with action accessories, such as vehicles and the like to enable the child to configure an action setting.

Some such action figures are provided with mechanisms within the torso, or one of the appendages, usually spring-actuated, to enable some form of action such as throwing a punch, or raising an arm or the like, in response to the operation of some control means, such as a depressible lever or the like. Some such figures have articulated or separable portions or are provided with other accessory items for simulating activity.

One such device is shown and described in U.S. Pat. No. 1,550,989, issued Aug. 25, 1925 to Stephens for a "Toy Block", this figure toy including a housing in the form of a block with hinged members therein pivotable to a position simulating a figure with the block resembling a torso.

Another animated figure toy is shown and described in U.S. Pat. No. 2,269,095, entitled "Game", issued Jan. 6, 1945, to Davis, the game including a pair of figure toys assembled to a platform, with members therebelow actuable to move the figures into proximity to simulate a boxing match.

Another animated toy in the form of an automobile is shown and described in U.S. Pat. No. 2,597,094, entitled "Impact Operated Toy", issued May 20, 1952, to Gutmann, the toy being in the form of a vehicle having the components thereof pivotably coupled with springs, and upon impact, the components pivot providing an impression of the vehicle being smashed to pieces.

U.S. Pat. No. 2,996,833, issued Aug. 22, 1961 to Giuliano is entitled "Amusement Device", such patent disclosing a figure toy in the form of an egg upon a wall and having a mechanism including a sound reproducing device driving a belt which topples the egg at a particular moment, the egg then falling into separate pieces, and, as a puzzle, can be reasssembled.

Another animation mechanism for a toy figure is shown and described in U.S. Pat. No. 3,346,989, entitled "Pneumatic Space Capsule", which patent issued to Ryan et al on Oct. 17, 1967, the toy figure having a simulated space suit with hinge parts mountable about a doll, the suit having resilient arm members pneumatically operated by a manually compressible bellows to change shape or position.

U.S. Pat. No. 3,874,112, entitled "Animating Device for Figure Toys" issued to Sapkus et al on Apr. 1, 1975, and shows a manually operable hand grip for attachment to a figure toy having articulated appendages for swinging the figure toy through simulated baseball-batting, or the like, activities.

Another animated toy is shown and described in U.S. Pat. No. 4,319,751, issued to Kurushima et al on Mar. 16, 1982, for "Hammer Game", the game including a pair of figures, each having a spring loaded head member detachable upon impact with a hammer pivotably carried by the other figure and actuable by the operator.

British Patent Specification No. 8133, by Headworth, accepted Mar. 2, 1916, discloses a "Mechanical Toy Bridge" which divides and springs open upon being struck in a certain spot.

It is an object of the present invention to provide a new and improved animated figure toy.

It is another object of the present invention to provide a new and improved spring operated animated figure toy configured as a robot, or the like.

It is a further object of the present invention to provide a new and improved animated figure toy having a head and torso portions hingedly coupled together for pivotable separation upon actuation of a plate member forming part of the chest.

SUMMARY OF THE INVENTION

The foregoing and other objects are accomplished by providing a figure toy having a lower torso with a trunnion member coupled for rotatable movement, the trunnion including hinge couplers connectable to mating hinge portions on the interior of front and rear halves of the upper torso. A spring is positioned beneath the trunnion for coaction with an actuating post slidingly captively retained within the trunnion for limited axial movement, the post having pivotably attached thereto a head and arm supporting housing with a head and arms thereon. Engaging interlocking fingers on the interior of the front and rear halves of the torso hold the parts together, with an actuating member slidably mounted on one of the fingers engageable by a plate portion on the front torso for separation of the arms and movement of the post under force of the spring to pivot the parts outwardly.

Other objects, features and advantages of the invention will become apparent from a reading of the specification, when taken in conjunction with the drawings, in which like reference numerals refer to like elements in the several views.

DESCRIPTION OF THE PREFERRED EMBODIMENT

Figure 1:
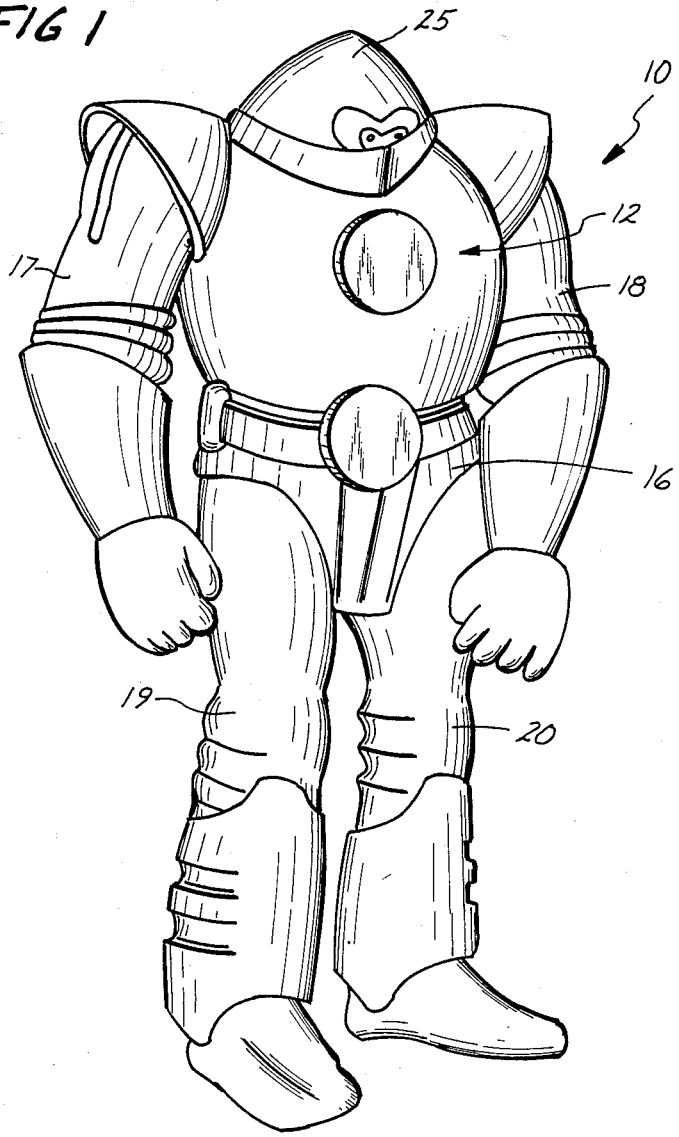
FIG. 1 is a perspective view of the animated figure toy according to the present invention.
Figure 2:
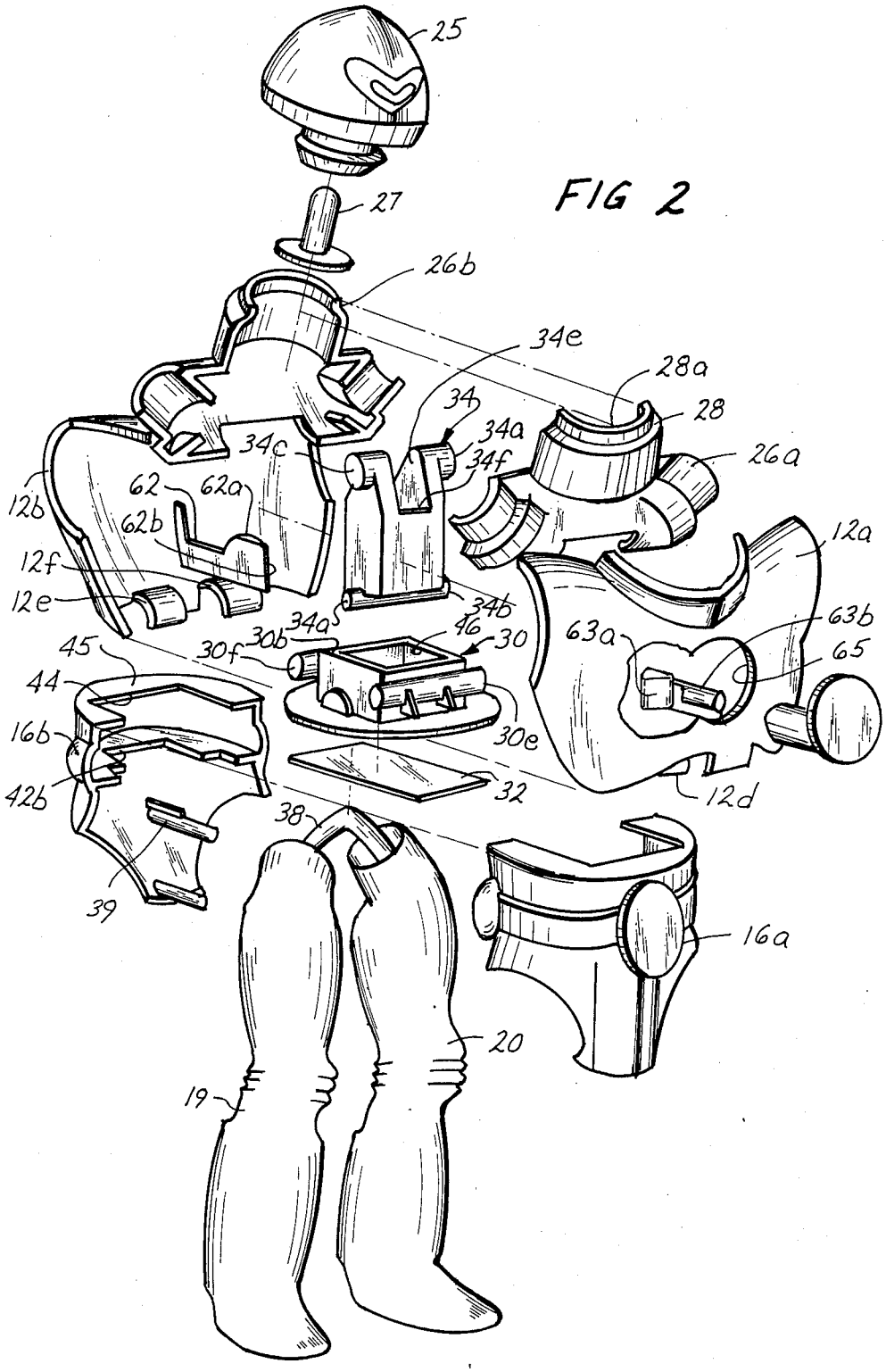
FIG. 2 is an exploded perspective view of the animated figure toy of FIG. 1 depicting the parts thereof.
Figure 6:
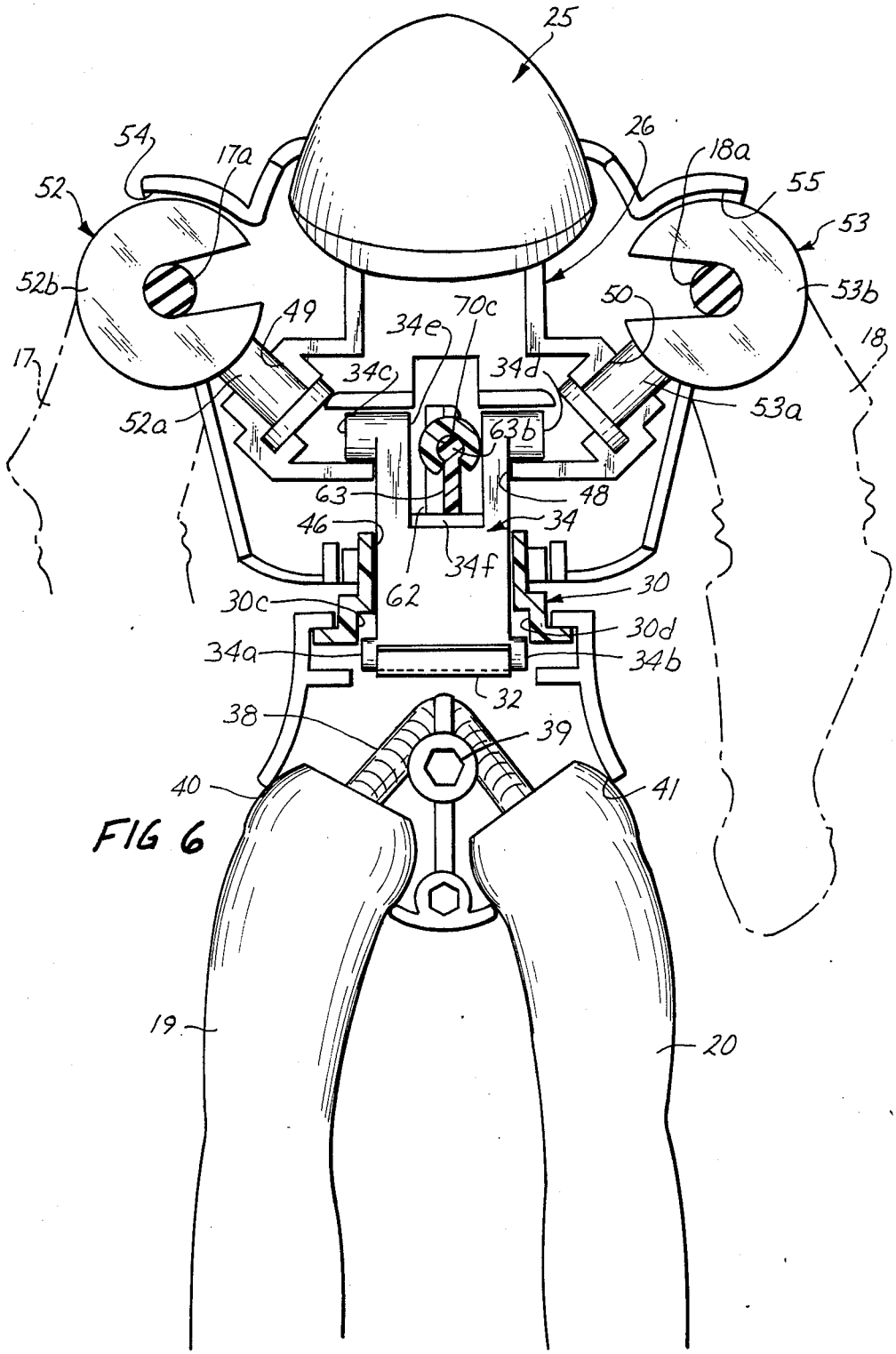
FIG. 6 is a partial cross-sectional view of the upper torso and head of the animated figure toy of FIG. 1, as viewed generally along a generally central plane extending the length thereof from side to side, illustrating the interior connections in the assembled position.

Referring now to the drawings, and particularly to FIGS. 1 and 2, there is shown a humanoid toy figure, generally designated 10, having a generally hollow upper torso, generally designated 12, formed of front and rear torso shell halves 12*a* and 12*b*, a generally hollow lower torso 16, a pair of arms 17 and 18, a pair of legs 19 and 20, and a head 25. Each of the arms 17 and 18 as well as the head 25 is supported in the upper torso 12, by an auxiliary head and arm support housing, generally designated 26 (See FIG. 6). Similarly, the legs 19 and 20 are attached in or to the lower torso 16 for positioning relative thereto.

The head 25 is configured in the form of a fanciful creature, such as a robotic archenemy of a superhero, or the like. Similarly the torsos 12 and 16, the arms 17 and 18, and the legs 19 and 20 are configured to provide an overall appearance of a robot like or humanoid figure.

As best shown in FIG. 2, it can be seen that the upper torso 12 and lower torso 16 are formed in two parts connectable together to define hollow openings, the two parts being designated with letter suffixes. Similarly the head and arm support housing 26 is formed of two parts 26*a* and 26*b* to form a hollow subhousing which captively supports therein the head member 25 and its associated head plug 27. The head and arm support housing 26 is formed with a neck portion 28 which is normally not visible when the toy 10 is in its normal position as shown in FIG. 1.

Contained within the hollow interior of the toy 10 are the following parts: a trunnion member generally designated 30, a spring plate member 32, and a post member generally designated 34, this post member 34 being adapted for interconnecting with the head support housing 26 as will be herafter described.

For assembly of the toy 10, the legs 19 and 20 are suitably interconnected by a flexible coupler member 38 formed of neoprene or the like having the opposite ends thereof secured within the hollow interiors of the legs 19 and 20 with the center portion thereof being hooked over connection pin 39 under tension within the lower torso halves 16*a* and 16*b*, with the upper ends of the legs 19 and 20 positioned within leg openings 40 and 41 of torso 16 (See FIG. 6) with torso 16 assembled. The interior of the upper portion of torso 16 is configured with a ledge portion 42 formed of portions 42*a* and 42*b* in spaced generally parallel relation to the opening 44 formed in the upper surface 45 of torso 16.

The spring plate member 32 is configured for positioning on the ledge portion 42. The trunnion member 30 has a disc shaped flange portion 30*a* configured for being rotatably or pivotably retained within the space between the ledge portion 42 and the surface 45 with spring plate member 32 thereunder. The upper portion 30*b* of trunnion member 30 is formed as a boxlike structure with a generally rectangular opening 46 extending therethrough in alignment with the longitudinal centerline of the toy FIG. 10.

The rectangular opening 46 of trunnion member 30 is configured for receiving therein the post member 34 in sliding captive relation. For this purpose, the main body portion of post member 34 is of generally rectangular cross-section slightly smaller then the dimensions of the opening 46. The lower edge of the post member 34 is provided with transversely extending aligned pivot projections 34*a* and 34*b* which engage mating recesses 30*c* and 30*d* formed on the interior of opening 46 of trunnion 30 adjacent the lower edge thereof (See FIGS. 3 and 6). The recesses 30*c* and 30*d* are open at the bottom edge to essentially form slots for enabling limited axial movement of post member 34 along the centerline of the figure toy 10.

As depicted in FIGS. 2 through 4 and 6, the trunnion 30 also includes, integrally formed therewith, first and second generally parallel front and rear hinge pins 30*e* and 30*f*, positioned and adapted to receive captively thereon hinge hooks 12*c*, 12*d* and 12*e*, integrally formed on the lower edges of the front and rear torso halves 12*a* and 12*b*. This interconnection permits pivoting of the front and rear torso halves 12*a* and 12*b* relative to the trunnion 30.

The upper end of post member 34 is provided with a second set of oppositely extending aligned pivot projections 34*c* and 34*d* with an intermediate vertically extending slotted opening at 34*e* with a lower edge 34*f*, the projections 34*c* and 34*d* lying along a line parallel to the axis formed by projections 34*a* and 34*b*. The head and arm support housing 26, when assembled, has a generally rectangular opening 48 (See FIG. 6) formed in the bottom thereof for passage therethrough of the main body portion of the post member 34.

By reference to FIGS. 2 through 4 and 6, the upper end of post member 34 pivotally supports the head and arm housing 26. The housing halves 26*a* and 26*b* have integrally formed on the interior thereof spaced aligned bearing cutouts, generally designated 49 and 50, which form the journals for rotatably receiving the flanged shaft portions 52*a* and 53*a* of first and second arm connectors, generally designated 52 and 53, respectively. The other ends 52*b* and 53*b* of the connectors 52 and 53 are generally C-shaped with the open end extending inwardly for receiving therein rod members 17*a* and 18*a* secured to the upper inner ends of arms 17 and 18, respectively. As connected, the arms 17 and 18 extend through arm openings 54 and 55, respectively, which are formed in the upper portion of the upper torso 12 at the shoulder portion thereof. With this connection, the C-shaped portions 52*b* and 53*b* permit pivoting about the axes of the rods 17*a* and 18*a*, in a direction toward and away from the sides of the torso 12, while pivoting of the connectors 52 and 53 about the shaft portions 52*a* and 53*a* enable rotation of the arms 17 and 18 along second axes to provide the same effect as a ball and socket joint coupling.

Figure 3:
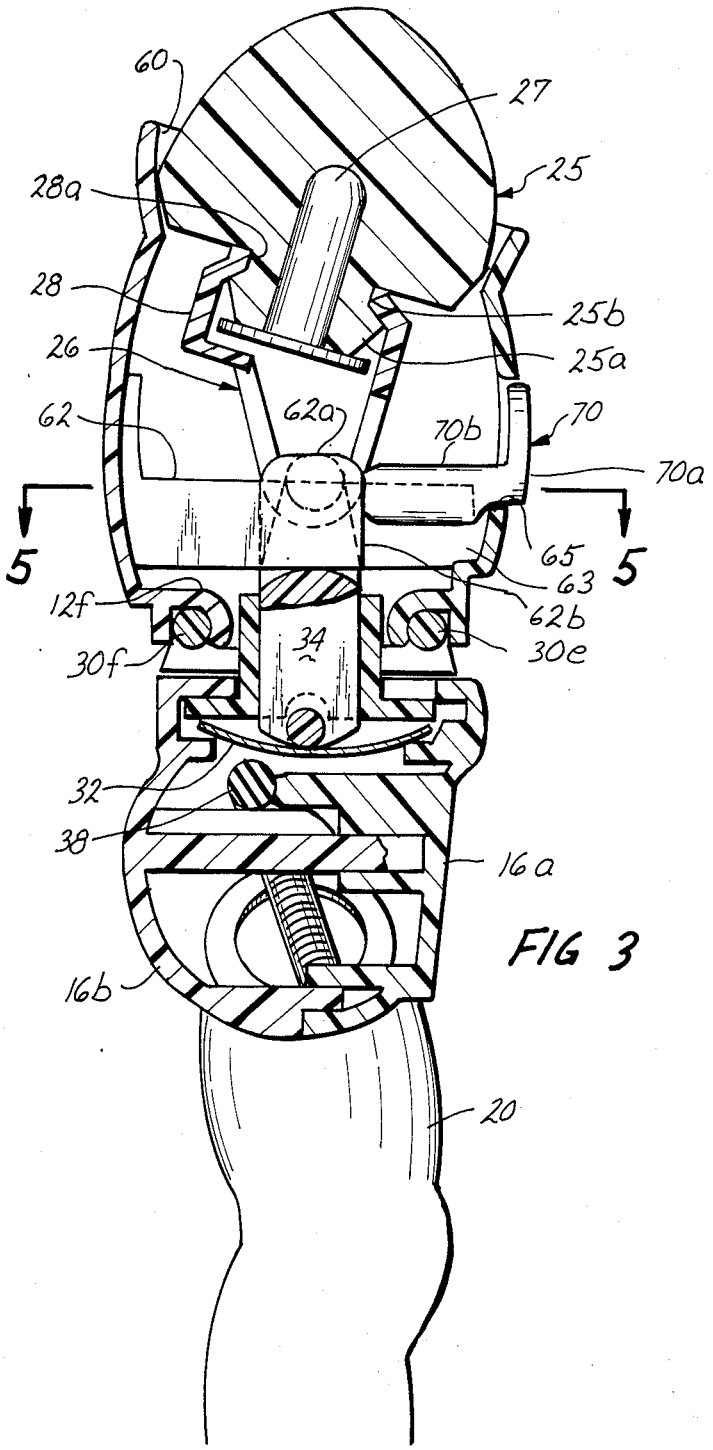
FIG. 3 is a partial cross-sectional view of the upper torso and head of the animated figure toy of FIG. 1, as viewed generally along a generally central plane extending through the longitudinal center line thereof, illustrating the interior connections in the assembled position.

The head member 25 has a depending centrally positioned projection 25*a* with a peripheral groove 25*b* which is secured by an inwardly extending peripheral ridge of opening 28*a* at the upper end of neck portion 28 of arm and head support housing 26. As best illustrated in FIG. 3, the upper end of torso 12 is configured to provide an enlarged head opening 60 for enabling the head member 25 to be partially received therein.

For interconnection of the front and rear halves of the torso 12, by reference to FIGS. 2 through 6, a generally blade-shaped flexible finger 62 is formed on the interior of the rear torso half 12*b* in generally perpendicular relation thereto. A matingly coacting generally blade-shaped flexible finger 63 is formed on the interior of the front torso half 12*a* in generally perpendicular relation thereto with the fingers 62 and 63 being dimensioned, configured and positioned for detachable engagement in the assembled position shown in FIG. 3. To effect this, the forward end 62*a* of finger 62 is enlarged in cross-section to form a barb, which engages a similar barb 63*a* formed at the end of finger 63, these fingers, upon engagement, overlapping, while being in general alignment from front to rear within the upper torso 12, as assembled. To permit interconnection of the fingers 62 and 63, the slot 34*e* of post member 34 is of sufficient size for passage of the fingers 62 and 63 therethrough (See FIG. 6).

As shown in FIG. 1, the upper torso half 12*a* has a chest opening 65 with the upper edge 63*b* of finger 63 extending partially into this opening at an approximate central position. An actuator member, generally designated 70, has a plate portion 70*a* of a shape and size corresponding to the opening 65 for insertion therethrough. The member 70 has an actuating arm portion 70*b* generally perpendicular to the plate portion 70*a* with a slotted opening 70*c* along the length thereof for slidable engagement with the cylindrically formed upper edge 63*b* of finger 63 (See FIG. 6). As shown in FIG. 3, upon assembly, the actuating arm portion 70*b* of actuator 70 extends below the lower edge of opening 65 to enable retention of actuator 70 on finger 63.

Figure 4:
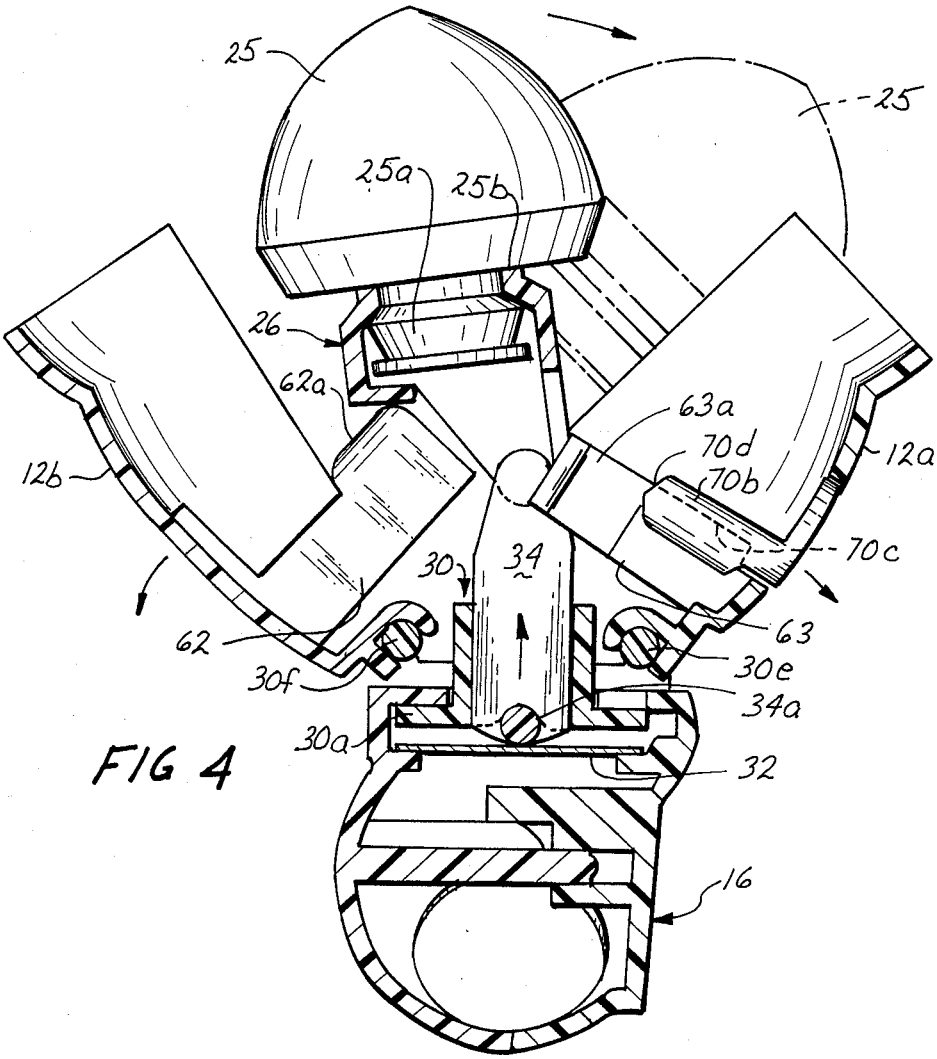
FIG. 4 is a cross-sectional view of the upper torso and head member similar to FIG. 3 with the operative parts pivoted after actuation.
Figure 5:
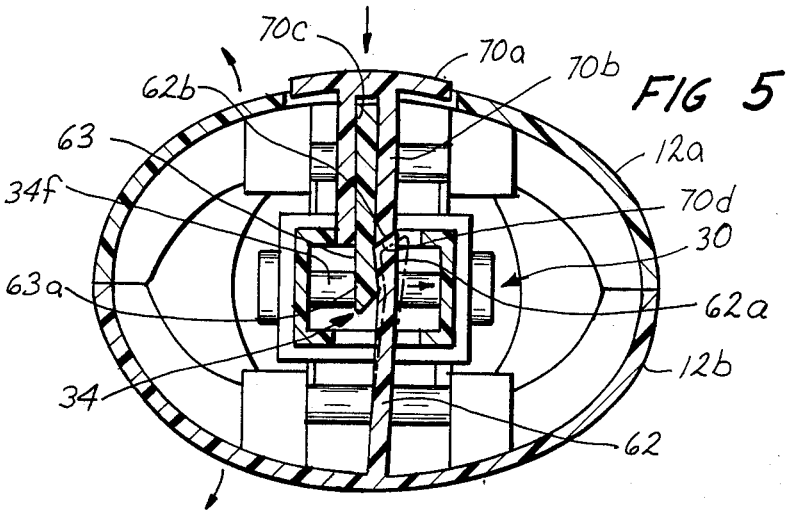
FIG. 5 is a cross-sectional view of the toy of FIG. 3 as viewed generally along line 5—5 thereof.

It is to be understood that the various components are preferably formed, such as by molding, of plastic materials having the requisite characteristics. In the case of the actuator 70 the material is preferably a rigid, somewhat resilient plastic which enables assembling of the actuator 70 to the finger 63 by a snap fit thus enabling sliding as well as retention thereon. As depicted in FIGS. 3 through 5, the coacting edge 70*d* of the arm portion 70*b* is provided with a tapered end which engages the tapered edge 62*b* of the barb 62*a*. This coaction will be hereafter described with reference to the description of operation of the toy 10.

For assembling the toy 10, the two halves 16*a* and 16*b* of the lower torso 16 is assembled with the post member 34 within the trunnion 30 with the spring plate member 32 therebelow and the legs 19 and 20 assembled as described. The upper torso rear half 12*b* has the hinge hooks 12*e* and 12*f* thereof snapped into engagement with the hinge pin 30*f* of trunnion 30. The actuator member 70 is snap fit onto the finger 63 of the front torso half 12*a* through the opening 65 thereof. The front torso half 12*a* then has the hinge hook 12*d* thereof snapped into engagement with the hinge pin 30*e* of trunnion 30. The head member 25, which is preferably formed of an expanded foam material such as PVC, has the neck plug 27 inserted therein and the head assembly is then positioned within the neck portion 28 of the arm and head supporting housing half 26*b*. The arms 17 and 18 are connected to the connectors 52 and 53 and the rods 17*a* and 18*a* are attached. The connectors 52 and 53 are then positioned within the housing half 26*b* and the half 26*a* is fixedly secured to the housing half 26*b*.

The toy 10 is then ready for interconnection by means of the interlocking barbs 62*a* and 63*a* of the fingers 62 and 63. Referring to FIG. 3, the head member 25 is depressed until the spring plate member 32 is deflected downwardly thereby storing energy in the spring member 32. The rear torso half 12*b* is then pivoted forwardly until the finger 62 thereof extends through the slotted opening 34*e* of the post member 34. The front torso half 12*a* is then pivoted rearwardly until the barb 63*a* of finger 63 engages barb 62*a* of finger 62, as shown in FIG. 5. During this interlocking the tapered forward edge 62*b* of barb 62*a* of finger 62 abuts against the matingly tapered end 70*d* of actuator arm 70 thereby forcing or sliding the actuator 70 outwardly.

Downward pressure on the head 25 is then released, at which point there is a slight retraction of the head 25 due to a slight upward movement of the post 34, which moves an increment sufficient for the lower arcuately configured edge 34*f* of the slotted opening 34*e* to abut against the lower edges of the interlocked barbs 62*a* and 63*a* positioned therein (See FIG. 3).

To cause the parts to pivot, a force is applied to the actuator plate 70*a* in the direction indicated by the arrow adjacent thereto in FIG. 3. By reference to FIG. 5, this inward force causes tapered edge 70*d* of actuator 70 to urge against the tapered edge 62*b* of finger 62 thus separating the barbed ends 62*a* and 63*a* of interconnected fingers 62 and 63, respectively. With the cammed edge 34*f* of post member 34 urging upwardly under the force of spring plate member 32, almost simultaneously, the front torso half 12*a* pivots forward, the rear torso half 12*b* pivots rearwardly, the head and arm support member 26 springs upwardly and rearwardly along with the head 25, as shown in FIG. 4, from the dotted line position to the solid line position, providing the illusion of complete destruction of the toy 10. With the parts captively retained, the toy 10 may then be reassembled and reused.

In accordance with the present invention, the animated figure toy 10 is provided with a body with hinged, pivotable and movable components in an economical, compact arrangement to provide a striking illusion. While there has been shown and described a preferred embodiment, it is to be understood that various other adaptations and modifications may be made within the spirit and scope of the invention.

I claim:

1. In a figure toy, the combination comprising:

an upper torso having first and second portions configured for forming a generally hollow interior;

lower torso means;

coupling means attached to said lower torso means for hingedly coupling said first and second portions of said upper torso thereto;

post means moveably connected to said coupling means;

spring means coupled for biasing said post means to a first position and for enabling manual actuation of said post means against the bias to a second position;

interconnecting means on said first and second portions for coaction with said post means for maintaining said post means in said second position against the force of the bias of said spring means and for detachably retaining said halves in an assembled position with said post means in said second position; and actuating means coacting with said interconnecting means for detachment thereof for enabling actuation of said post means to said first position for pivotally separating said first and second halves.

2. The toy according to claim 1 wherein said coupling means includes means for providing pivotal movement between said upper torso and said lower torso means.

3. The toy according to claim 2 wherein said coupling means is a trunnion member having an opening therein receiving said post means.

4. The toy according to claim 3 wherein said spring means is a spring member within said lower torso means beneath said post means.

5. The toy according to claim 4 wherein said post means is a post member, and said toy further includes head means coupled to the upper end of said post member.

6. The toy according to claim 1 wherein said interconnecting means are finger members on the interior of said first and second portions of said upper torso, said finger members having barb means on the ends thereof and being positioned for interlocking engagement.

7. In a figure toy, the combination comprising:

an upper torso having first and second halves;

lower torso means;

coupling means attached to said lower torso means for hingedly coupling said first and second halves of said upper torso thereto;

post means having one end thereof captively connected to said coupling means for movement along the longitudinal centerline of the toy;

spring means coupled for biasing said post means to a first position and for enabling manual actuation of said post means against the bias to a second position;

head means coupled to the other end of said post means for movement therewith;

interconnecting means on said first and second halves for coaction with said post means for maintaining said post means in said second position against the force of the bias of said spring means and for detachably retaining said halves in an assembled position with said post means in said second position; and means on said upper torso adapted for coaction with said interconnecting means for enabling actuation of said post means to said first position for pivotally separating said first and second halves.

8. The toy according to claim 7 wherein said coupling means includes means for enabling relative pivoting of said upper torso and said lower torso means.

9. The toy according to claim 7 wherein said interconnecting means includes detachably engaging finger members formed on the interiors of said first and second halves.

10. The toy according to claim 7 wherein said coupling means is a trunnion member pivotably coupled to said lower torso means.

11. In a figure toy, the combination comprising:

an upper torso having first and second halves;

lower torso means;

a trunnion member pivotably coupled to said lower torso means for hingedly coupling said first and second halves of said upper torso thereto, said trunnion member including an opening therein;

post means moveably captively connected to said coupling means said post means being slidably captively coupled within said opening;

spring means coupled for biasing said post means to a first position and for enabling manual actuation of said post means against the bias to a second position;

head means coupled to said post means for movement therewith;

interconnecting means on said first and second halves for detachably retaining said halves in an assembled position with said post means in said second position; and means on said upper torso adapted for coaction with said interconnecting means for enabling actuation of said post means to said first position for pivotally separating said first and second halves.

12. The toy according to claim 11 wherein said trunnion member includes hinge means for coaction with mating hinge means on said first and second halves of said upper torso.

13. The toy according to claim 12 wherein said spring means includes a spring member mounted within said lower torso means beneath said opening for coaction with said post means.

14. The toy according to claim 13 wherein said head means includes a head support member and a head member attached thereto, said head support member being pivotably coupled to said post means.

15. The toy according to claim 14 wherein said toy further includes arm members pivotally coupled to said head support member.

16. In a figure toy, the combination comprising:

an upper torso having first and second halves;

a lower torso having leg members coupled thereto;

a trunnion member pivotably coupled to said lower torso, and including means for hingedly coupling said first and second halves of said upper torso thereto, said trunnion having an opening therein in alignment with the longitudinal centerline of the toy;

a post member moveably captively connected to said trunnion within said opening;

spring means within said lower torso coupled for biasing said post member to a first position and for enabling manual actuation of said post member against the bias to a second position;

head means coupled to said post member for movement therewith;

interconnecting means on said first and second halves of said upper torso for detachably retaining said halves in an assembled position with said post member in said second position; and means on said upper torso adapted for coaction with said interconnecting means for enabling actuation of said post means to said first position for pivotally separating said first and second halves.

17. The toy according to claim 16 wherein said interconnecting means includes detachably engaging finger members formed on the interiors of said first and second halves.

18. The toy according to claim 17 wherein said means on said upper torso for coaction with said interconnecting means includes an actuating member slidably coupled to one of said finger members.

19. In a figure toy, the combination comprising:

an upper torso having first and second portions configured for forming a generally hollow interior;

lower torso means;

coupling means attached to said lower torso means for hingedly coupling said first and second portions of said upper torso thereto;

a slotted post member moveably connected to said coupling means;

spring means coupled for biasing said post means to a first position and for enabling manual actuation of said post means against the bias to a second position;

interconnecting means including finger members on the interior of said first and second portions of said upper torso member, said finger members having barb means on the ends thereof and being positioned for interlocking engagement, said finger members, in the interlocked position, extending into and coacting with the slot of said post member for retaining said post means in said second position and detachably retaining said portions in an assembled position with said post means in said second position; and actuating means coacting with said interconnecting means for detachment thereof for enabling actuation of said post means to said first position for pivotally separating said first and second portions.

20. In a figure toy, the combination comprising:

an upper torso having first and second halves;

lower torso means;

coupling means attached to said lower torso means for hingedly coupling said first and second halves of said upper torso thereto;

post means moveably captively connected to said coupling means;

spring means coupled for biasing said post means to a first position and for enabling manual actuation of said post means against the bias to a second position;

head means coupled to said post means for movement therewith;

interconnecting means including detachably engaging finger members formed on the interiors of said first and second halves for detachably retaining said halves in an assembled position with said post means in said second position; and means on said upper torso including an actuating member slidably coupled to one of said finger members for coaction with said interconnecting means for enabling actuation of said post means to said first position for pivotally separating said first and second halves.

21. The toy according to claim 20 wherein said actuating member includes a depressible plate portion on said upper torso.

22. In a figure toy having a longitudinal centerline, the combination comprising:

an upper torso having first and second portions configured for forming a generally hollow interior;

lower torso means;

coupling means attached to said lower torso means for coupling said first and second halves of said upper torso thereto for pivotal movement about axes generally perpendicular to the longitudinal centerline;

post means having an end thereof connected to said coupling means for movement along the longitudinal centerline;

spring means coupled for biasing said post means to a first position and for enabling manual actuation of said post means against the bias to a second position;

interconnecting means on the interior of said first and second portions for coaction with said post means for maintaining said post means in said second position against the force of bias of said spring means and for detachably retaining said portions in an assembled position with said post means in said second position; and actuating means coacting with said interconnecting means for detachment thereof for enabling actuation of said post means to said first position for pivotally separating said first and second halves.

23. The toy according to claim 22 wherein said toy further includes head means connected to the other end of said post means, said first and second portions of said upper torso being configured for receiving said head means therebetween.

24. The toy according to claim 22 wherein said coupling means is a trunnion member for providing pivotal movement between said upper torso and said lower torso means.

25. The toy according to claim 24 wherein said trunnion member has an opening therein for slidably receiving said post means.

26. The toy according to claim 22 wherein said interconnecting means includes finger members projecting from the interior of said portions, said finger members including barbed ends configured for interlocking engagement.

* * * * *